US006216520B1

(12) United States Patent
Ochi et al.

(10) Patent No.: US 6,216,520 B1
(45) Date of Patent: Apr. 17, 2001

(54) ROLLING MILL

(75) Inventors: Shigeharu Ochi; Hiroshi Fujiwara, both of Niihama; Sho Inui, Tokyo; Takaaki Toyooka, Handa; Motoaki Itadani, Chita-gun; Akira Yorifuji, Handa; Toshio Onishi; Koji Sugano, both of Chita-gun; Mikio Kodaka, Handa; Nobuki Tanaka, Nagoya, all of (JP)

(73) Assignees: Kawasaki Steel Corporation, Tokyo; Sumitomo Heavy Industries, LTD, Kobe, both of (JP)

( * ) Notice: Subject to any disclaimer, the term of this patent is extended or adjusted under 35 U.S.C. 154(b) by 0 days.

(21) Appl. No.: 09/376,320

(22) Filed: Aug. 18, 1999

(30) Foreign Application Priority Data

Jul. 29, 1999 (JP) ..... 11-214454
Jul. 29, 1999 (JP) ..... 11-214455

(51) Int. Cl.[7] ..... B21B 31/07; B21B 13/10
(52) U.S. Cl. ..... 72/249; 72/224
(58) Field of Search ..... 72/249, 237, 224, 72/225; 74/665 GC, 665 H

(56) References Cited

U.S. PATENT DOCUMENTS 2,094,920 * 10/1937 Inslee ..... 72/249
2,495,387 * 1/1950 Rummins ..... 72/249
2,887,915 * 5/1959 Friedman ..... 72/249
3,296,845 * 1/1967 Prutton ..... 72/249
5,857,371 * 1/1999 Bindernagel et al. ..... 72/224

* cited by examiner

*Primary Examiner*—Rodney A. Butler
(74) *Attorney, Agent, or Firm*—Arent Fox Kintner Plotkin & Kahn, PLLC

(57) ABSTRACT

A rolling mill comprising a roll unit and a drive unit for driving the roll unit. The drive unit comprises an outer housing, a pair of large-diameter ring-like driving bevel gears disposed concentric with the pass line, an input shaft mechanism for rotating the driving bevel gears, and transmission mechanisms for transmitting the torque of the driving bevel bears to the rolls. Each transmission mechanism comprises a small-diameter transmission bevel gear caught between and engaging with the driving bevel gears and first and second transmission shafts for transmitting the torque of the transmission bevel gear to a roll. The drive and roll units are coupled and uncoupled by couplings. Four positioning parts are formed on the outer periphery of the inner housing of the roll unit. The outer housing of the drive unit is generally in the shape of a ring, and four positioning parts are formed on the inner periphery of the outer housing. When the inner housing is fitted into the outer housing, the inner housing is positioned in the outer housing by the positioning parts laterally and longitudinally and also in both directions of the pass line by stoppers and hold-downs.

15 Claims, 11 Drawing Sheets

PRIOR ART

PRIOR ART

ROLLING MILL

BACKGROUND OF THE INVENTION

The present invention relates generally to a rolling mill, and more particularly to a rolling mill to roll materials into products such as steel bars, wires, and pipes. The word of "products" used in this specification means a concept including steel bars, wires, and pipes.

A number of four-roll or three-roll rolling mills arranged in series roll material in four or three directions repeatedly, reducing its sectional area gradually, to form it into a desired shape of desired dimensions.

FIGS. 10 and 11 show a typical four-roll rolling mill used for such rolling work as mentioned above.

The rolling mill has an input shaft 101, which drives the four rolls 102, 103, 104, and 105. Each of the four rolls 102, 103, 104, and 105 has bevel gears (102*b*, 103*b*, 104*b*, or 105*b* as the case may be) on both its sides. The driving power of the input shaft 101 is transmitted through the bevel gears 102*b*, 103*b*, 104*b*, and 105*b*.

Given this structure, the size of the bevel gears 102*b*–105*b* has to be smaller than the diameter of the rolls 102–105 and, hence, the torque-transmitting capacity of the bevel gears 102*b*–105*b* is limited. Therefore, this structure can not be adopted for rolling mills of large capacity.

In FIG. 11, a four-roll rolling mill having the same structure as the above rolling mill is turned around the pass line by 45° so as to protrude the input shaft to the upper right. This configuration makes a reducer to be connected to the input shaft 101 bulky and high, increasing the equipment cost and the necessary installation space.

On the other hand, the four-roll rolling mill disclosed in the Japanese Unexamined Patent Publication No. 71704/H4 has a bevel gear mounted on each of the four roll shafts and gears which are disposed on the back or the front of the housing and engages the four bevel gears to transmit the driving power.

This structure makes rolling mills thick and, hence, unsuitable to rolling mills such as stretch reducers which require to minimize the stand-to-stand spacing.

The three-roll rolling mill disclosed in the Japanese Unexamined Patent Publication No. 70305/H2 has in its housing a large-diameter hypoid gear of which the outer diameter is slightly smaller than the inner diameter of the housing. The input shaft of the rolling mill has an input hypoid gear which engages and rotates the large-diameter hypoid gear, which in turn engages the driven hypoid gears of the three roll shafts to drive the three rolls.

In this configuration, although the offsets between the center of the large-diameter hypoid gear and the driving and driven small-diameter hypoid gears are determined by the tooth profile, such arrangement as two large-diameter hypoid gears catch small-diameter hypoid gears between them is impossible, because such two large-diameter hypoid gears require offsets in two directions opposite to each other. Accordingly, only one large-diameter hypoid gear can be used in this configuration, which makes the configuration unsuitable to large-capacity rolling mills.

In accordance with the above, an object of the present invention is to provide a rolling mill which is thin and compact and has large capacity and of which the driving reducer is compact and low.

In case of a tandem rolling mill consisting of mill housings of more than 20 stands such as a stretch reducer, because housings have to be provided in accordance with its product sizes, the total number of housings comes to over 100.

Therefore, if every housing contains a driving gear mechanism, the cost of the whole equipment becomes huge.

In accordance with the above, another object of the present invention is to make compact the housings of a tandem rolling mill consisting of many rolling stands and reduce the cost of the housings.

SUMMARY OF THE INVENTION

According to the first aspect of the present invention, there is provided a rolling mill comprising (i) a housing, (ii) a roll unit having a plurality of rolls arranged to roll material and (ii) a drive unit to drive the roll unit. The drive unit further comprises (i) a large-diameter ring-like driving bevel gear, (ii) an input shaft mechanism for rotating the driving bevel gear, and (iii) transmission mechanisms each for transmitting the driving torque of the driving bevel gear to a roll.

According to the second aspect of the present invention, there is provided the rolling mill of the first aspect, wherein (i) the drive unit has two driving bevel gears disposed face to face, and (ii) each transmission mechanism comprises a small-diameter transmission bevel gear caught between and engaging with the two driving bevel gears and a transmission shaft mechanism for transmitting the driving torque of the transmission bevel gear to a roll.

According to the third aspect of the present invention, there is provided the rolling mill of the second aspect, wherein each transmission shaft mechanism comprises (i) a first transmission shaft on which the transmission bevel gear is fixed, (ii) a first cylindrical gear fixed on the first transmission shaft, (iii) a second transmission shaft connected to the roll shaft of a roll, and (iv) a second cylindrical gear fixed on the second transmission shaft and engaging the first cylindrical gear.

According to the fourth aspect of the present invention, there is provided the rolling mill of the first or second aspect, wherein the input shaft mechanism comprises an input shaft inserted from the outside to the inside of the housing and a small-diameter input bevel gear fixed on the input shaft and engaging the driving bevel gear(s).

According to the fifth aspect of the present invention, there is provided the rolling mill of the fourth aspect, wherein (i) the roll unit comprises four rolls of a pair of horizontal rolls and a pair of vertical rolls, and (ii) the input shaft of the input shaft mechanism is disposed horizontally, taking the place of the first transmission shaft of a transmission shaft mechanism and driving the second transmission shaft.

According to the sixth aspect of the present invention, there is provided the rolling mill of the fourth aspect, wherein (i) the roll unit comprises four rolls of a pair of slant rolls and another pair of slant rolls, the latter crossing the former at a right angle, and (ii) the input shaft of the input shaft mechanism is disposed horizontally.

According to the seventh aspect of the present invention, there is provided the rolling mill of the fourth aspect, wherein (i) the roll unit comprises three rolls arranged 120° apart around the pass line, and (ii) the input shaft of the input shaft mechanism is disposed horizontally.

According to the eighth aspect of the present invention, there is provided the rolling mill of the first aspect, wherein (i) the housing comprises an inner housing holding the roll unit and an outer housing holding the drive unit, (ii) the outer housing is generally in the shape of a ring, and (iii) the driving bevel gear has an outer diameter slightly smaller than the inner diameter of the outer wall of the outer housing and an inner diameter larger than the diameter of a circle in contact with the outmost points of the rolls.

According to the ninth aspect of the present invention, there is provided the rolling mill of the eighth aspect, wherein (i) the drive unit has two driving bevel gears disposed face to face, (ii) each transmission mechanism comprises a small-diameter transmission bevel gear caught between and engaging with the two driving bevel gears and a transmission shaft mechanism for transmitting the driving torque of the transmission bevel gear to a roll, and (iii) the outer housing is split into a front section and a rear section. One of the two driving bevel gears is journaled on a bearing in the front section, and the other driving bevel gear is journaled on a bearing in the rear section.

According to the tenth aspect of the present invention, there is provided a rolling mill comprising (i) a housing which comprises an inner housing and an outer housing, (ii) a roll unit which comprises a plurality of rolls arranged in and held by the inner housing to roll material and (ii) a drive unit which comprises a driving means held in the outer housing to drive the roll unit. The roll unit and the drive unit are coupled by couplings capable of coupling and uncoupling.

According to the eleventh aspect of the present invention, there is provided the rolling mill of the tenth aspect, wherein (i) the inner housing holding the roll unit has four positioning parts formed on its outer periphery and (ii) the outer housing holding the drive unit is generally in the shape of a ring and has four positioning parts formed on its inner periphery. The roll unit is positioned in the drive unit by putting the positioning parts of the inner housing in contact with the positioning parts of the outer housing.

According to the twelfth aspect of the present invention, there is provided the rolling mill of the eleventh aspect, wherein a means for fixing the roll unit to the drive unit is provided. The fixing means comprises (i) stoppers which are formed on the inner edge of the outer housing and protruding inward on one side, i.e., rolling-in side or rolling-out side, of the rolling mill, (ii) hold-downs placed over the inner edge of the outer housing and the outer edge of the inner housing on the other side, i.e., rolling-out side or rolling-in side, as the case may be, of the rolling mill, and (iii) a means for fixing the hold-downs to the outer housing.

According to the thirteenth aspect of the present invention, there is provided the rolling mill of the tenth aspect, wherein the inner housing is split into a front section and a rear section. The rolls can be held in the inner housing by coupling its front and rear sections, and the rolls can be taken out from the inner housing by uncoupling its front and rear sections.

According to the fourteenth aspect of the present invention, there is provided the rolling mill of the tenth aspect, wherein the outer housing is split into a front section and a rear section. The driving means can be held in the outer housing by coupling its front and rear sections, and the driving means can be separated and taken out from the outer housing by uncoupling its front and rear sections.

According to the fifteenth aspect of the present invention, there is provided the rolling mill of the eleventh aspect, wherein the four positioning parts of the inner housing and the four positioning parts of the outer housing have contacting surfaces for positioning the inner housing in the outer housing in the lateral and longitudinal directions and in the rotating directions about the pass line.

The advantages offered by the first aspect of the invention are mainly as follows. The rolls are driven by the large-diameter ring-like bevel gear disposed separately from the rolls. Therefore, large torque can be transmitted to the rolls irrespective of their diameter and, hence, the capacity of the rolling mill can be made large. Because no driving gear is required on the front or the back of the housing, the rolling mill can be configured thin, allowing to minimize the stand-to-stand spacing in a rolling line such as a stretch reducer.

The advantage offered by the second aspect of the invention is as follows. Because torque is transmitted by the two driving bevel gears which catch the transmission bevel gears between them, large torque can be transmitted. Therefore, the capacity of the rolling mill can be made large without increasing the thickness of its housing.

The advantage offered by the third aspect of the invention is as follows. Because cylindrical gears are used to transmit the torque from the driving bevel gears to the rolls, the transmission mechanism is simple and capable of transmitting large torque.

The advantage offered by the fourth aspect of the invention is as follows. Because the input shaft mechanism to rotate the driving bevel gear(s) is simple, comprising only an input shaft and a small-diameter input bevel gear, the rolling mill can be made compact.

The advantage offered by the fifth aspect of the invention is as follows. Because the input shaft is disposed horizontally, its connection to a driving reducer can be made compact and low. In addition, because no transmission bevel gear is required in the driving reducer, it can be made compact.

The advantage offered by the sixth aspect of the invention is as follows. Because the input shaft is disposed horizontally, notwithstanding the slant arrangement of the rolls, the connection between the input shaft and a driving reducer can be made compact and low.

The advantage offered by the seventh aspect of the invention is as follows. Because the three-roll rolling mill has a horizontal input shaft, its connection to a driving reducer can be made compact and low.

The advantage offered by the eighth aspect of the invention is as follows. Because the driving bevel gear put around the rolls can be given such a large diameter as is slightly smaller than the inner diameter of the outer wall of the outer housing, the driving bevel gear can transmit large driving power.

The advantage offered by the ninth aspect of the invention is as follows. Because two driving bevel gears are mounted in the front and rear sections, respectively, of the outer housing, the reactions arising from the transmission of torque and working on the driving bevel gears offset each other, allowing smooth rotation of the rolls.

The advantages offered by the tenth aspect of the invention are as follows. Roll units and drive units can be coupled and arranged in a rolling line, and roll units and drive units can be stored and managed separately by uncoupling them by couplings. Besides, because roll units for producing products of various sizes have no drive mechanism, they are almost free of maintenance and they can be made in a large number (for example, over 100) at a low cost. Moreover, because one drive unit and one stand-by drive unit suffice for each rolling mill regardless of the number of sizes of products, the cost of a rolling line can be reduced significantly. Furthermore, unlike the rolling mills of prior arts, it is unnecessary to disassemble the drive unit each time rolls are changed. Therefore, rolls can be changed in a very short time, and there is no risk of damaging the drive unit.

Because the lubrication system of the drive unit is packaged in the unit, it is unnecessary to change lubricant each time rolls are changed.

The advantages offered by the eleventh aspect of the invention are as follows. The roll unit can be positioned in the drive unit just by putting the positioning parts of the inner housing in contact with the positioning parts of the outer housing. Besides, the ring-like outer housing has large resistance against external forces in radial directions. Thus, high rolling precision is ensured.

The advantage offered by the twelfth aspect of the invention is as follows. Because the inner housing is fixed in the outer housing by the stoppers and the hold-downs, the roll unit is fixed securely in the drive unit and no displacement occurs in either direction of the pass line. Thus, the rolling precision is improved.

The advantages offered by the thirteenth aspect of the invention are as follows. Rolls can be changed just by uncoupling the front and rear sections of the inner housing. Since rolls can be changed easily, it is not necessary to prepare one roll unit for each product size. One roll unit can be used for producing products of several sizes by changing rolls in the roll unit. Thus, the cost of a rolling line can be reduced significantly.

The advantage offered by the fourteenth aspect of the invention is as follows. Just by removing the front section or the rear section of the outer housing, the driving means can be taken out from and built in the outer housing. Therefore, the inspection and maintenance of the driving means are very easy.

The advantage offered by the fifteenth aspect of the invention is as follows. Because the inner housing can be positioned in the outer housing in the lateral and longitudinal directions and in the rotating directions about the pass line, no excessive force works on the couplings between the drive and roll units; therefore, the rolling mill can operate smoothly.

BRIEF DESCRIPTION OF THE DRAWINGS

The features and advantages of the present invention will become more clearly appreciated from the following description in conjunction with the accompanying drawings, in which.

DETAILED DESCRIPTION OF THE PREFERRED EMBODIMENTS

With reference to the drawings, a preferred embodiment of the present invention will now be described.

Figure 1:
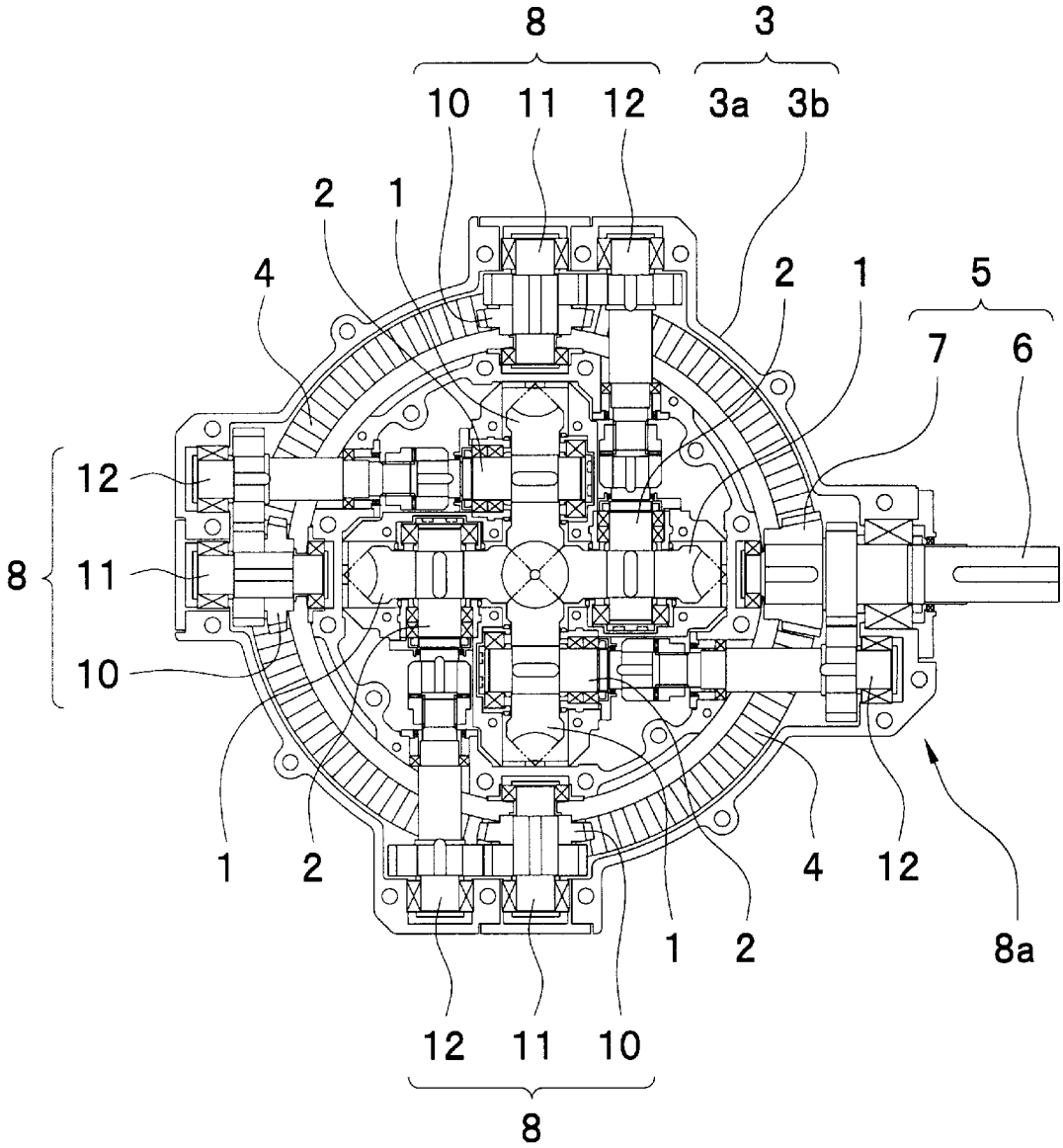
FIG. 1 is a front view of an embodiment of rolling mill of the present invention, the front section of its housing removed.

The rolling mill of FIG. 1 is of a four-roll type, having a pair of horizontal rolls 1 and 1 and a pair of vertical rolls 1 and 1. The four rolls 1 are arranged around the pass line, and material is rolled in the rolling grooves of the rolls 1. A roll shaft 2 is fixed to the center of each roll 1. The numeral 3 represents a ring-like outer housing to retain a pair of driving bevel gears 4 and transmission mechanisms 8, both described later. The outer housing 3 is split into a front section 3*a* (not shown in FIG. 1) and a rear section 3*b*. The housing 3 will be described in detail later with reference to FIG. 3.

The four rolls 1 are retained by an inner housing (not shown), which is set in the outer housing 3.

The outer housing 3 is generally in a ring-like shape, and the large-diameter, ring-like, driving bevel gears 4 are disposed in the outer housing 3. Because the driving bevel gears 4 have an outer diameter slightly smaller than the inner diameter of the outer wall of the outer housing 3 and are disposed concentric with the pass line, they are considerably large. The inner diameter of the driving bevel gears 4 is larger than the diameter of a circle in contact with the outmost points of the four rolls 1.

The numeral 5 represents an input shaft mechanism, which comprises an input shaft 6 and an input bevel gear 7 fixed on the input shaft 6. When the input shaft 6 is rotated by a motor and a reducer (both not shown), the driving bevel gears 4 are rotated about the pass line.

Each transmission mechanism 8 comprises a transmission bevel gear 10 engaging with and rotated by the driving bevel gears 4, a first transmission shaft 11, a second transmission shaft 12, and so on. Each transmission mechanism 8 drives and rotates a roll 1.

The details of the above rolling mill will now be described.

Figure 3:
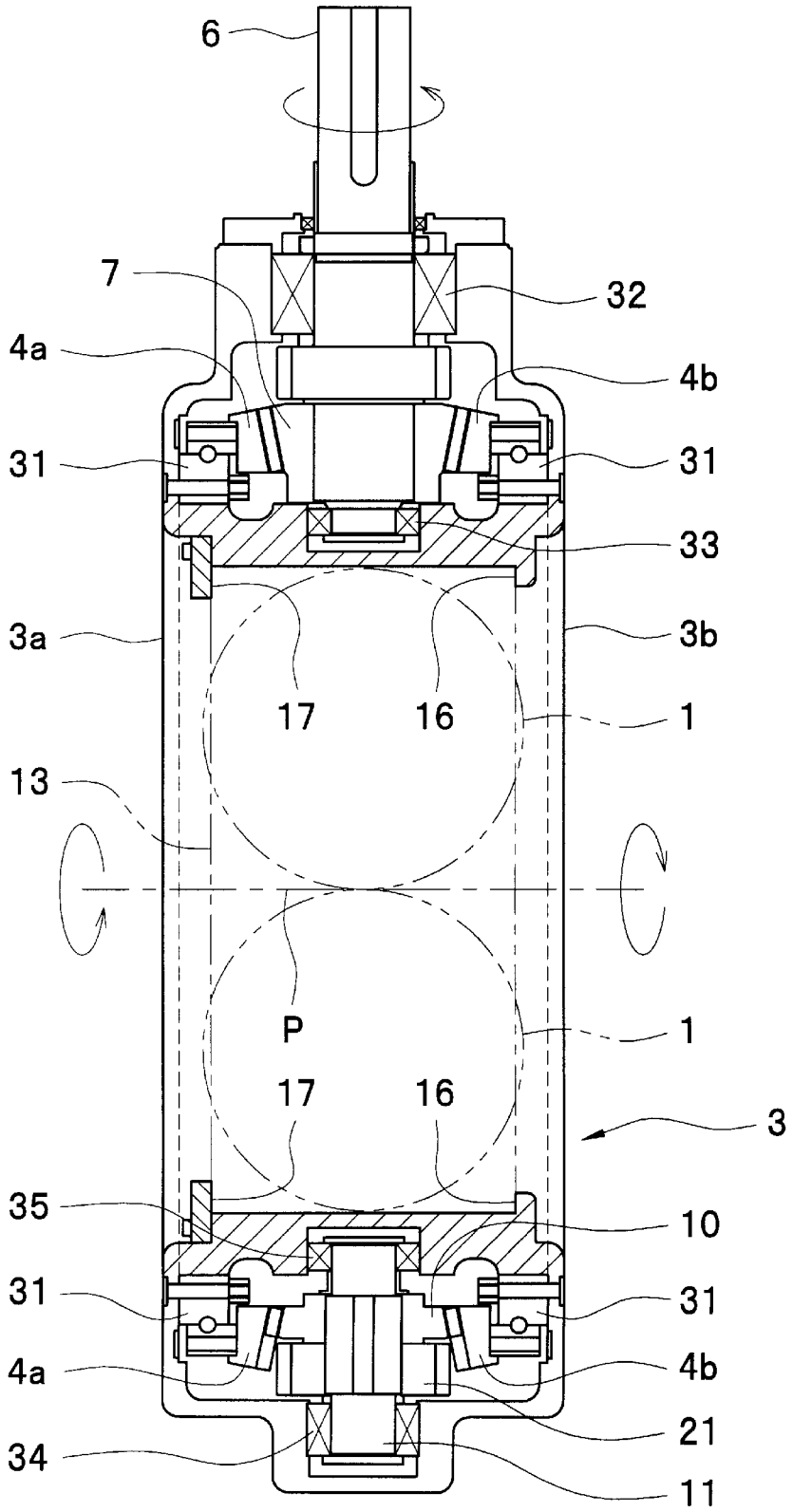
FIG. 3 is a sectional side view of the rolling mill of FIG. 1.

As shown in FIG. 3, the outer housing 3 consists of a front section 3*a* and a rear section 3*b*. A front driving bevel gear 4*a* is journaled on a bearing 31 in the front housing section 3*a*; a rear driving bevel gear 4*b*, on a bearing 31 in the rear housing section 3*b*. These front and rear driving bevel gears 4*a* and 4*b* are called driving bevel gears 4 when it is unnecessary to distinguish the front side from the rear side.

The input shaft 6 is journaled in a bearing 32 at its middle part and in a bearing 33 at its top so as to be freely rotatable relatively to the outer housing 3. The input bevel gear 7 fixed on the input shaft 6 engages the front and rear driving bevel gears 4*a* and 4*b* to rotate them in two directions opposite to each other.

Figure 2:
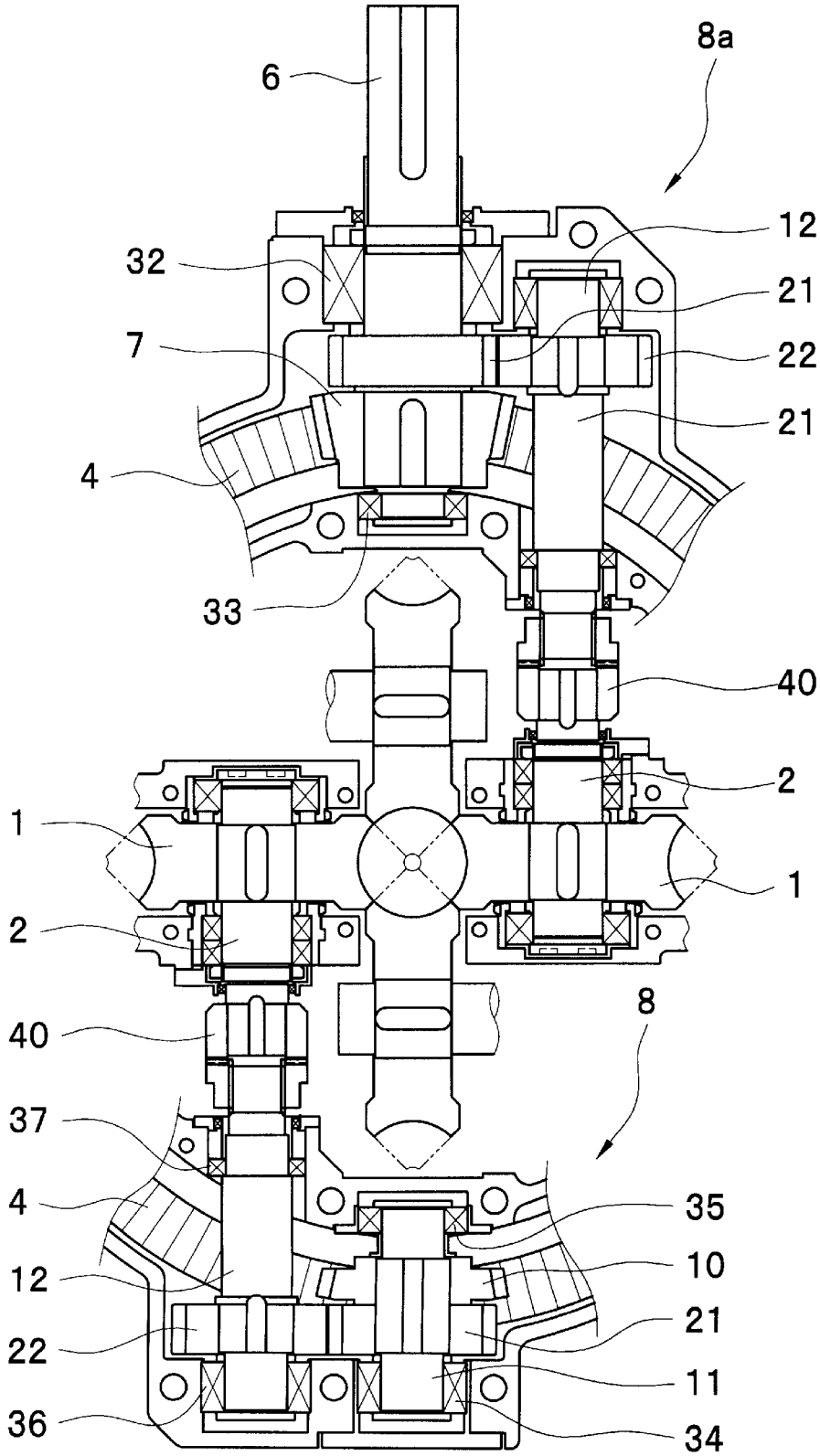
FIG. 2 is an enlarged view of a part of the rolling mill of FIG. 1.

FIGS. 2 and 3 show the details of the transmission mechanisms 8. In each transmission mechanism 8, a first transmission shaft 11 is journaled in bearings 34 and 35. A small-diameter transmission bevel gear 10 and a first cylindrical gear 21 are fixed on the first transmission shaft 11. Because the transmission bevel gear 10 is driven by the driving bevel gears 4 as mentioned above, the first transmission shaft 11 is rotated.

On the other hand, a second transmission shaft 12 is disposed in parallel with the first transmission shaft 11 and journaled in bearings 36 and 37.

Fixed on the second transmission shaft 12 is a second cylindrical gear 22, which engages the first cylindrical gear 21. The second transmission shaft 12 is connected to a roll shaft 2 by a coupling 40 capable of coupling and uncoupling.

The first and second cylindrical gears 21 and 22 may be spur wheels or helical gears.

Three of the four rolls 1 are driven by the above transmission mechanisms 8. The roll 1 corresponding positionally to the input shaft 6 is provided with a transmission mechanism 8a wherein there is not a first transmission shaft 11 because the input shaft 6 is disposed in the place of the first transmission shaft 11, and the input shaft 6 has a first cylindrical gear 21 to drive a second transmission shaft 12.

Given the above configuration, when the two driving bevel gears 4*a* and 4*b* rotate, the four rolls 1 rotate.

As described above, because two large-diameter driving bevel gears 4*a* and 4*b* are used to transmit torque, the capacity of the rolling mill can be made large. In a addition, because no driving gear is required on the front or the back of the housing, the rolling mill can be made thin. This feature is suitable to stretch reducers which require to minimize the stand-to-stand spacing.

Figure 4:
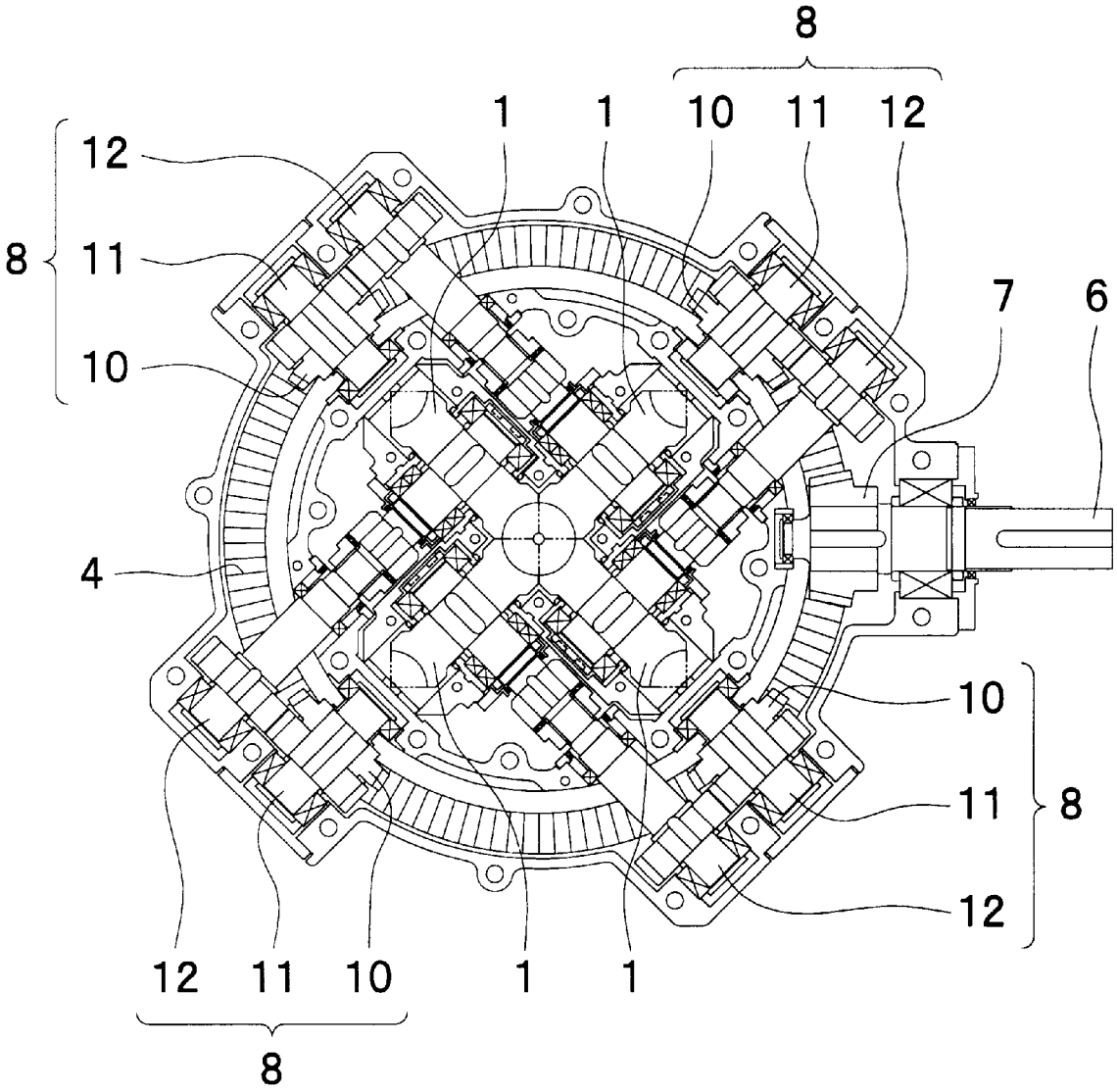
FIG. 4 is a front view of another embodiment of rolling mill of the present invention, the front section of its housing removed.

In FIG. 4, four rolls 1 are arranged in a slant posture. In this arrangement, because no transmission mechanism 8 takes a horizontal position, every roll 1 is driven by a transmission mechanism 8 comprising a first transmission shaft 11 and a second transmission shaft 12. Accordingly, only an input bevel gear 7 is mounted on the input shaft 6; a first cylindrical gear is not necessary.

According to prior arts, the driving shaft of a slant-roll rolling mill extends to the upper right, making its connection to a reducer bulky and high. According to the present invention, however, because the input shaft 6 can be disposed horizontally as shown in FIG. 4, its connection to a reducer can be made low and compact.

Although the above embodiments relate to four-roll rolling mills, the transmission mechanism 8 and the input shaft mechanism 5 can be applied to three-roll rolling mills. Namely, three rolls and three transmission mechanisms 8 are arranged 120° apart around the pass line, and driving bevel gears 4 are disposed in the same manner as in the four-roll rolling mills to drive the three rolls. Because the input shaft of the input shaft mechanism 5 can be positioned horizontally, its connection to a driving reducer can be made compact and low.

Another embodiment of four-roll rolling mill of the present invention will now be described.

Figure 5:
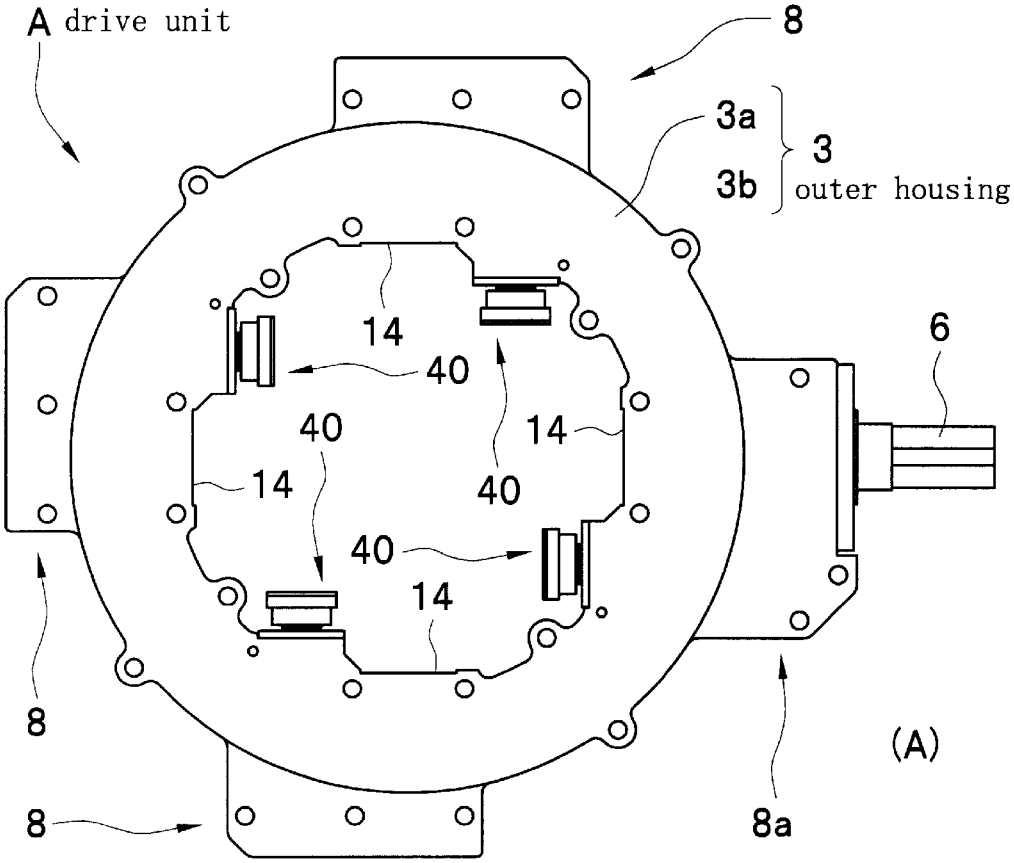
FIGS. 5(A) and 5(B) are front views of the drive unit and the roll unit of the rolling mill of FIG. 1.
Figure 5:
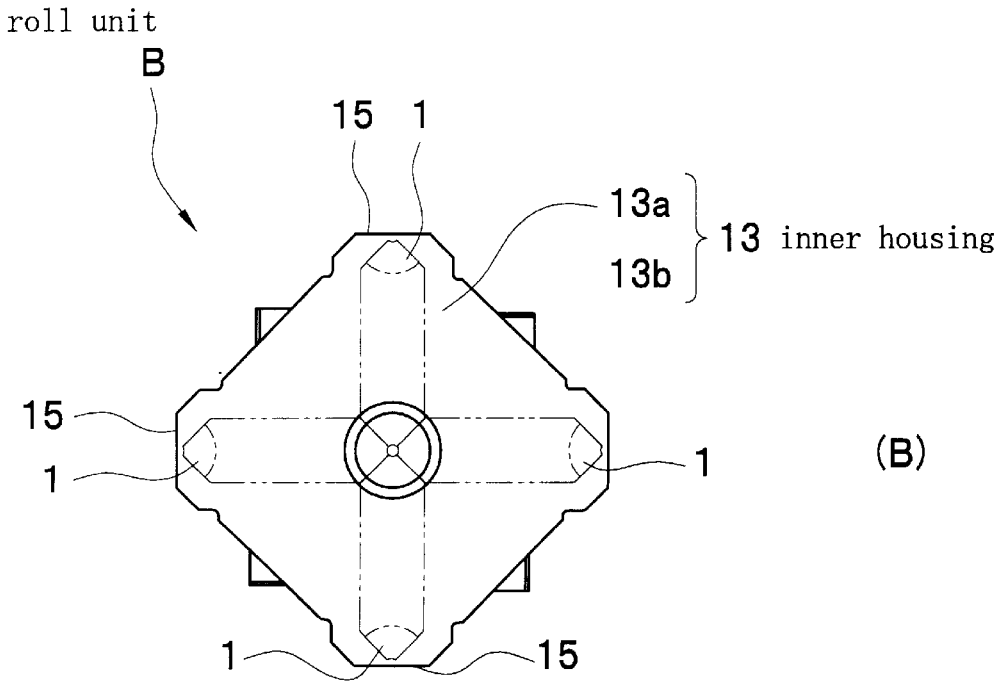

FIG. 5(A) is a front view of a drive unit A; FIG. 5(B), a front view of a roll unit B. The drive unit A comprises an outer housing 3, which is split into a front section 3*a* and a rear section 3*b*, and a driving means (to be described later) housed in the outer housing 3. The front section 3*a* is appearing in FIG. 5 (A) , but the rear section 3*b* is invisible.

The outer housing 3 is generally in the shape of a ring, and flat positioning parts 14 are formed at the top, bottom, right, and left parts of the inner periphery.

The roll unit B comprises an inner housing 13, which is split into a front section 13*a* and a rear section 13*b*, and four rolls 1 housed in the inner housing 13. The front section 13*a* is appearing in FIG. 5(B), but the rear section 13*b* is invisible.

The inner housing 13 is generally square, and flat positioning parts 15 are formed on its four corners.

Figure 6:
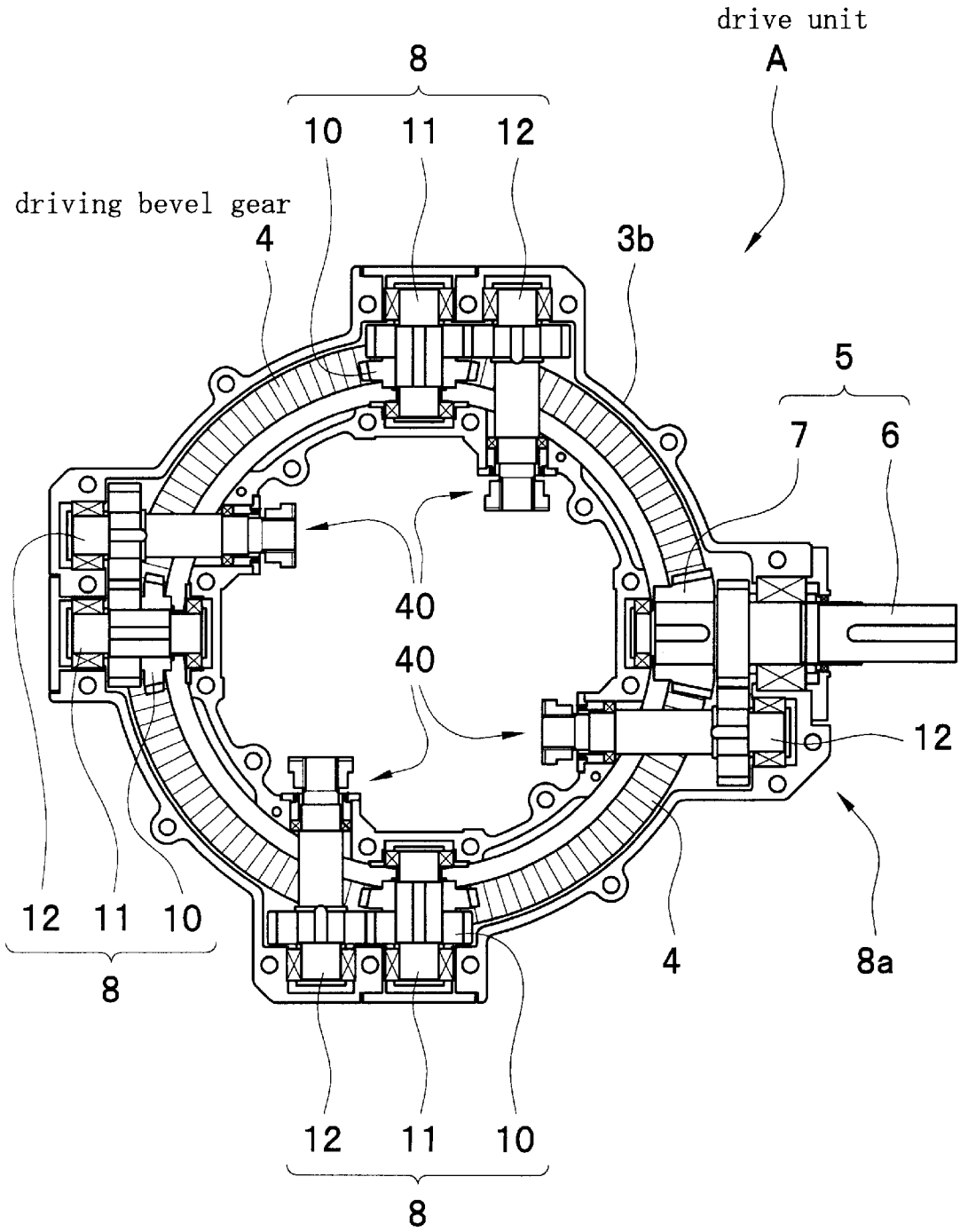
FIG. 6 is a front view of the drive unit of FIG. 5(A), the front section of its housing removed.

FIG. 6 shows the drive unit A. A pair of large-diameter, generally ring-shaped, driving bevel gears 4 are disposed in the outer housing 3 (only the rear section 3*b* is appearing in FIG. 6). Because the driving bevel gears 4 have an outer diameter slightly smaller than the inner diameter of the outer wall of the outer housing 3 and is disposed concentric with the pass line, they are considerably large. The inner diameter of the driving bevel gears 4 is larger than the diameter of a circle in contact with the outmost points of the four rolls 1.

The numeral 5 represents an input-shaft mechanism, which comprises an input shaft 6 and an input bevel gear 7 mounted on the input shaft 6. When the input shaft 6 is driven by a motor through a reducer (both not shown), the driving bevel gears 4 rotate about the pass line.

The numeral 8's represent transmission mechanisms. Each transmission mechanism 8 comprises a transmission bevel gear 10 engaging the driving bevel gears 4, a first transmission shaft 11, a second transmission shaft 12, and so on. Each transmission mechanism 8 drives a roll 1. A half of a coupling 40 (described later) is mounted on the inner end of each second transmission shaft 12.

Figure 7:
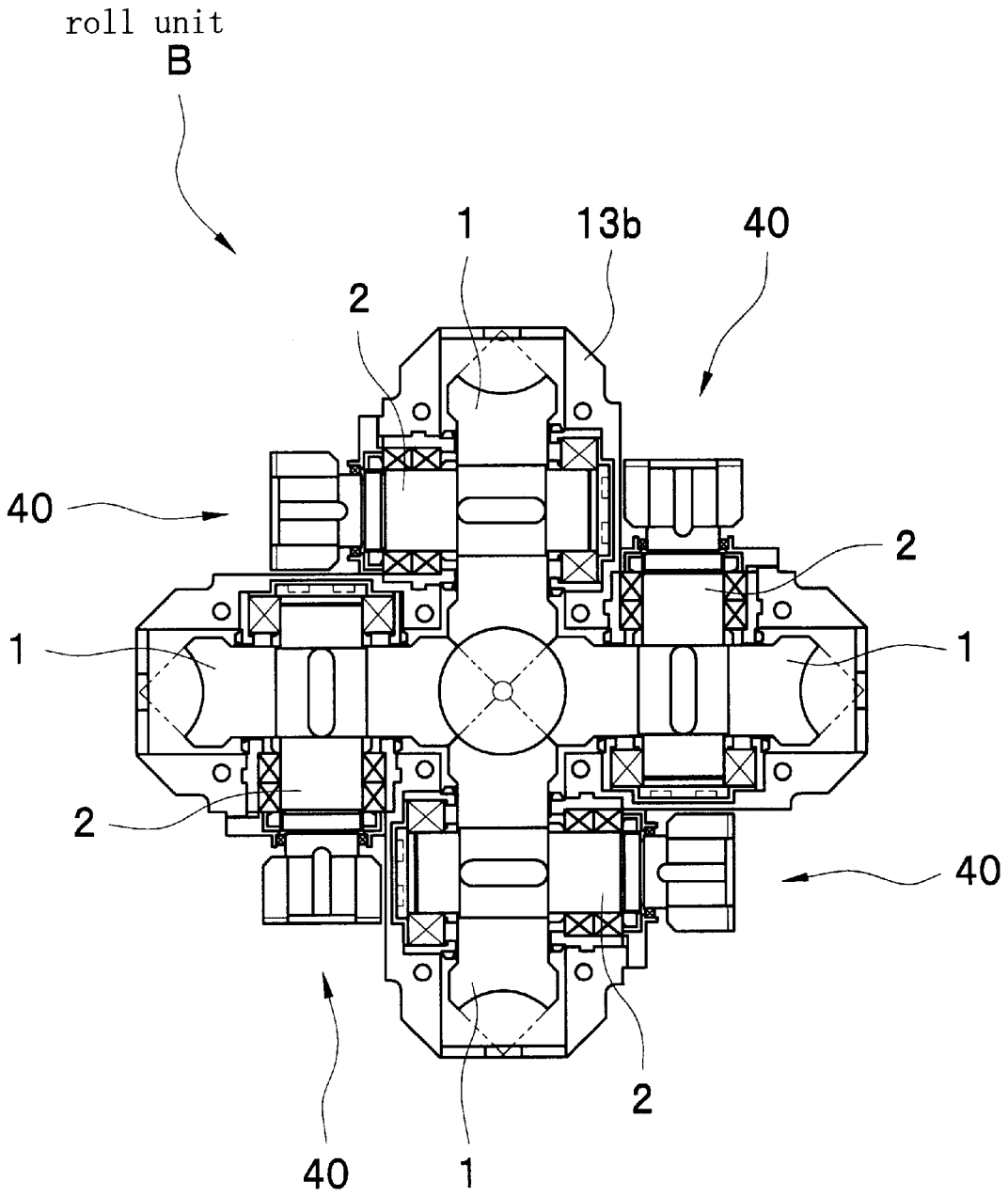
FIG. 7 is a front view of the roll unit of FIG. 5(B), the front section of its housing removed.

FIG. 7 shows the roll unit B of FIG. 5(B), the front section 13*a* of the inner housing 13 is removed. A pair of horizontal rolls 1 and 1 and a pair of vertical rolls 1 and 1 are built in the inner housing 13. Namely, the roll unit B is a four-roll type. The four rolls 1 are arranged so as to be able to roll material, and material is rolled in the rolling grooves of the rolls 1 into a rod, or wire, or pipe. A roll shaft 2 is fixed to the center of each roll 1, and each roll shaft 2 is journaled in bearings held by the front and rear sections 13*a* and 13*b* of the inner housing 13.

A half of a coupling 40 is mounted on the driven end of each roll shaft 2.

As is shown in FIG. 3, the outer housing 3 consists of front and rear sections 3*a* and 3*b*, and a driving means to be described later can be held in the outer housing 3 by coupling its front and rear sections 3*a* and 3*b*.

The outer housing 3 is provided with a fixing means to fix the inner housing 13. Namely, stoppers 16 protruding inward are formed on the inner edge (for example, at the positioning parts 14) of the rear section 3*b* of the outer housing 3. When the inner housing 13 is fitted into the outer housing 3, the movement of the inner housing 13 in the pass line's direction is checked by the stoppers 16. On the other hand, holding plates 17 are placed over the inner edge (for example, at the positioning parts 14) of the front section 3*a* of the outer housing 3 and the outer edge (for example, at the positioning parts 15) of the inner housing 13. The hold-downs 17 are fixed to the outer housing 3 with a fixing means such as bolts.

The driving means consists essentially of the pair of driving bevel gears 4 and the transmission mechanisms 8. One of the driving bevel gears 4 (front driving bevel gear 4*a*) is journal on a bearing 31 in the front section 3*a* of the outer housing 3; the other driving bevel gear 4 (rear driving bevel gear 4*b*), on a bearing 31 in the rear section 3*b*.

The input shaft 6 is, halfway and at its top, supported in bearings 32 and 33, respectively, so as to be freely rotatable relatively to the outer housing 3. The input bevel gear 7 mounted on the input shaft 6 engages the front and rear driving bevel gears 4*a* and 4*b* to turn them in two directions opposite to each other.

Referring to FIGS. 2 and 3, the transmission mechanisms 8 will be described in detail.

The first transmission shaft 11 of each transmission mechanism 8 is journaled in bearings 34 and 35. A transmission bevel gear 10 of a small diameter and a first cylindrical gear 21 is mounted on the first transmission shaft 11. When the transmission bevel gear 10 is driven by the driving bevel gears 4 as mentioned early, the first transmission shaft 11 rotates.

On the other hand, the second transmission shaft 12 is disposed in parallel with the first transmission shaft 11 and journaled in bearings 36 and 37.

A second cylindrical gear 22 is mounted on the second transmission shaft 12 and engaging the first cylindrical gear 21. The second transmission shaft 12 is connected to a roll shaft 2 by a coupling 40. The first and second cylindrical gears 21 and 22 may be spur wheels or helical gears.

As is shown in FIG. 1, three of the four rolls 1 are driven by the transmission mechanisms 8. The roll 1 corresponding positionally to the input shaft 6 is provided with a transmission mechanism 8*a* wherein there is not a first transmission shaft 11 because the input shaft 6 is disposed in the place of the first transmission shaft 11, and the input shaft 6 has a first cylindrical gear 21 to drive a second transmission shaft 12.

Figure 8:
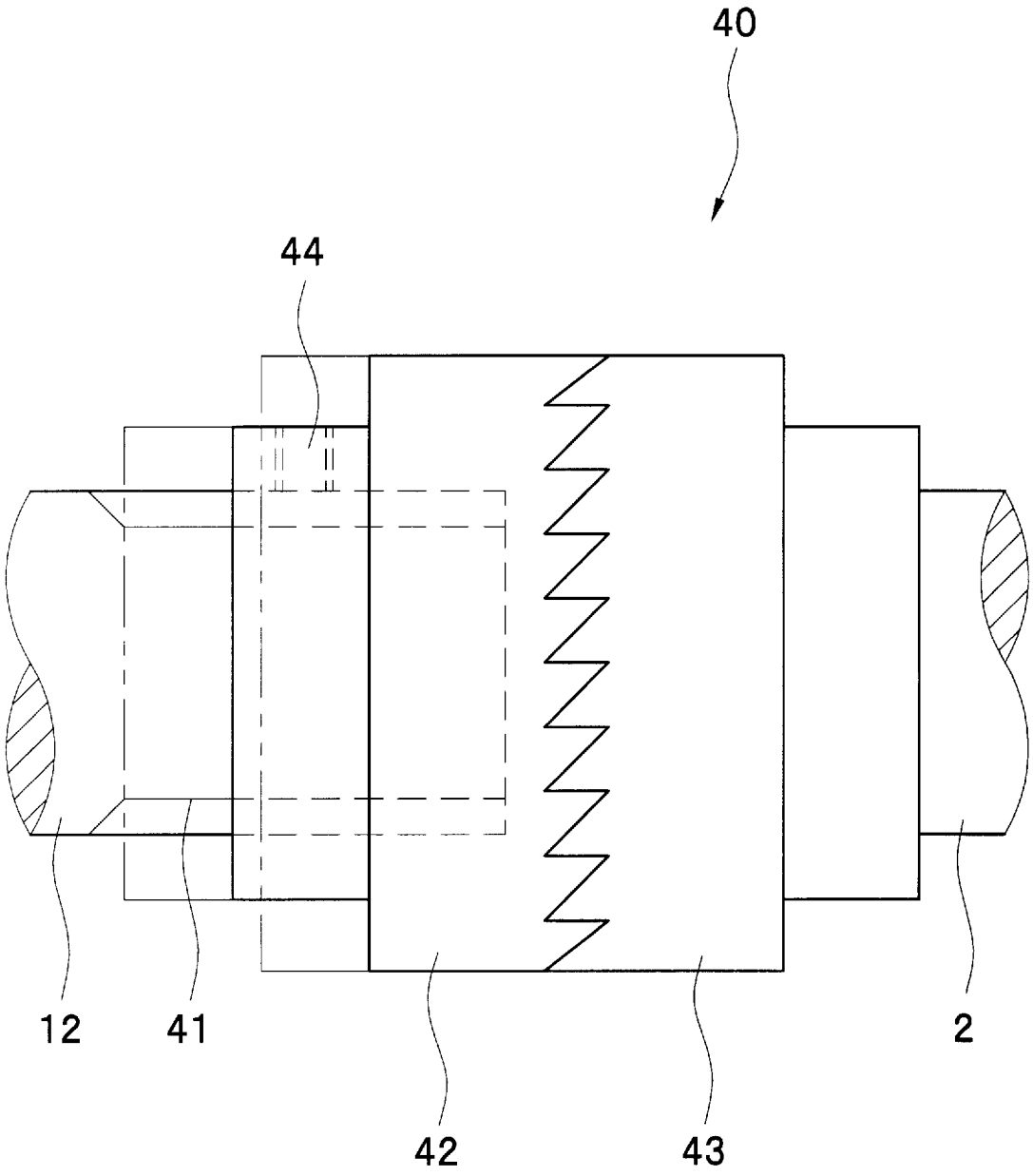
FIG. 8 is a plan of one form of a coupling of FIG. 2.

FIG. 8 shows a coupling 40.

A spline 41 is formed in the inner end portion of the second transmission shaft 12, and a coupling half 42 is fitted on the splined portion so as to be freely slidable. The other coupling half 43 is fixed to the end of the roll shaft 2. The coupling halves 42 and 43 have teeth or dogs to engage each other. The numeral 44 indicates a set bolt for the slidable coupling half 42. When the slidable coupling half 42 is retracted, it disengages from the coupling half 43. Thus, the roll unit B can be coupled to and uncoupled from the driving unit A. While the roll unit B is set in the driving unit A, the driving power of the drive unit A can be transmitted to the roll unit B by putting forward the coupling halves 42 and engaging them with the coupling halves 43. The coupling 40 can be of any types capable of coupling and uncoupling.

Figure 9:
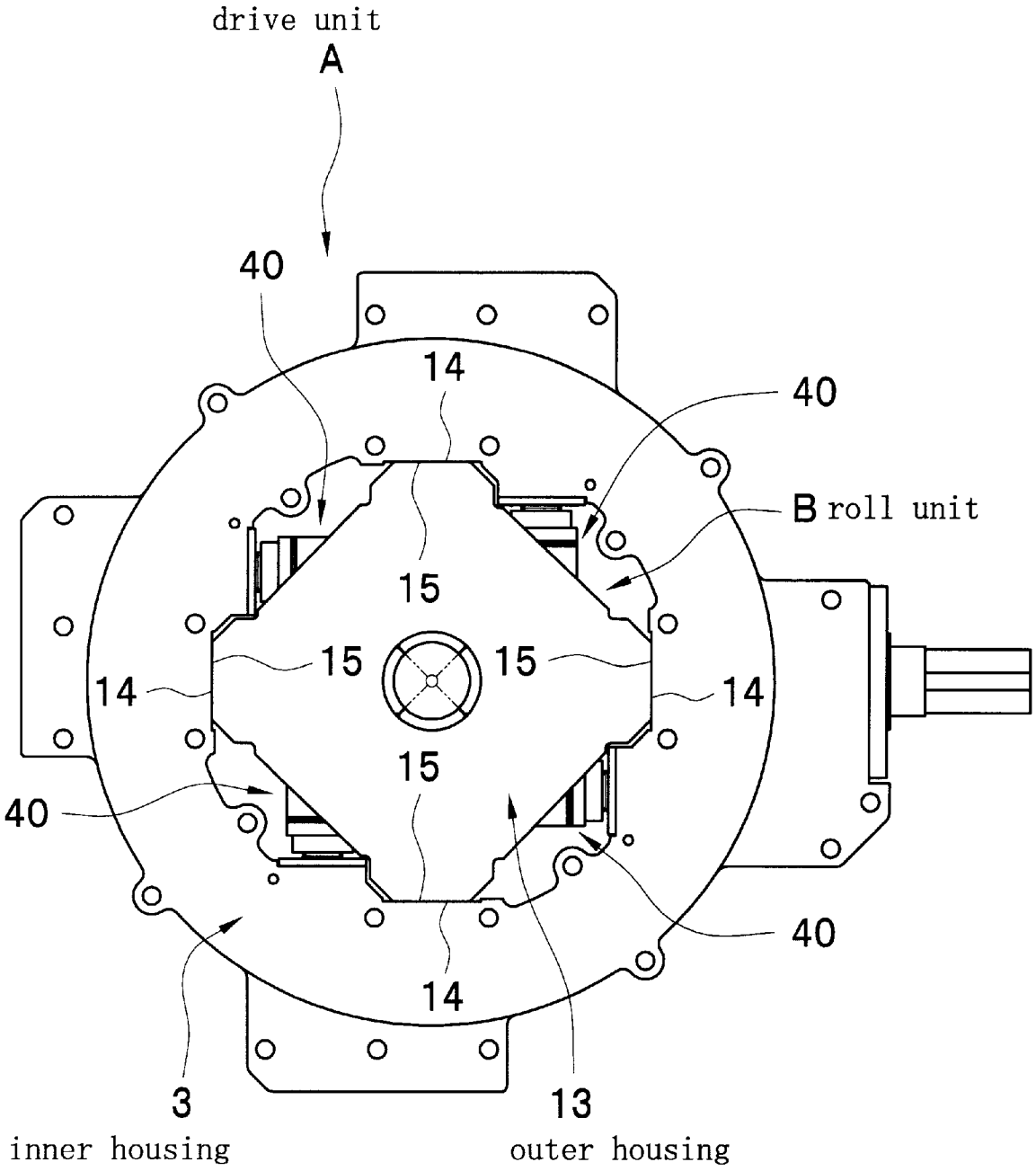
FIG. 9 is a front view of the drive and roll units of FIGS. 5(A) and 5(B) joined together.
Figure 10:
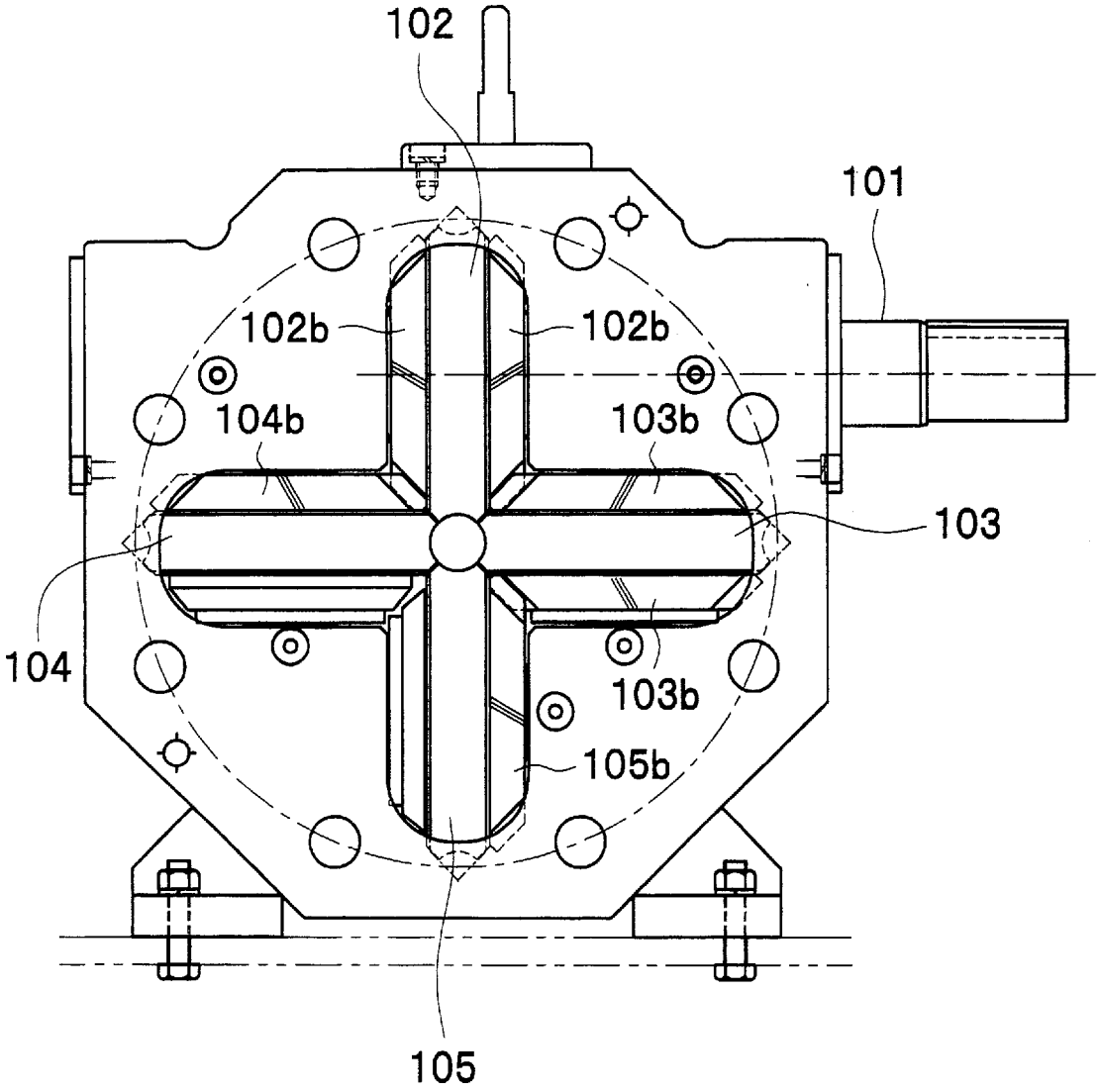
FIG. 10 is a front view of a conventional four roll rolling mill.
Figure 11:
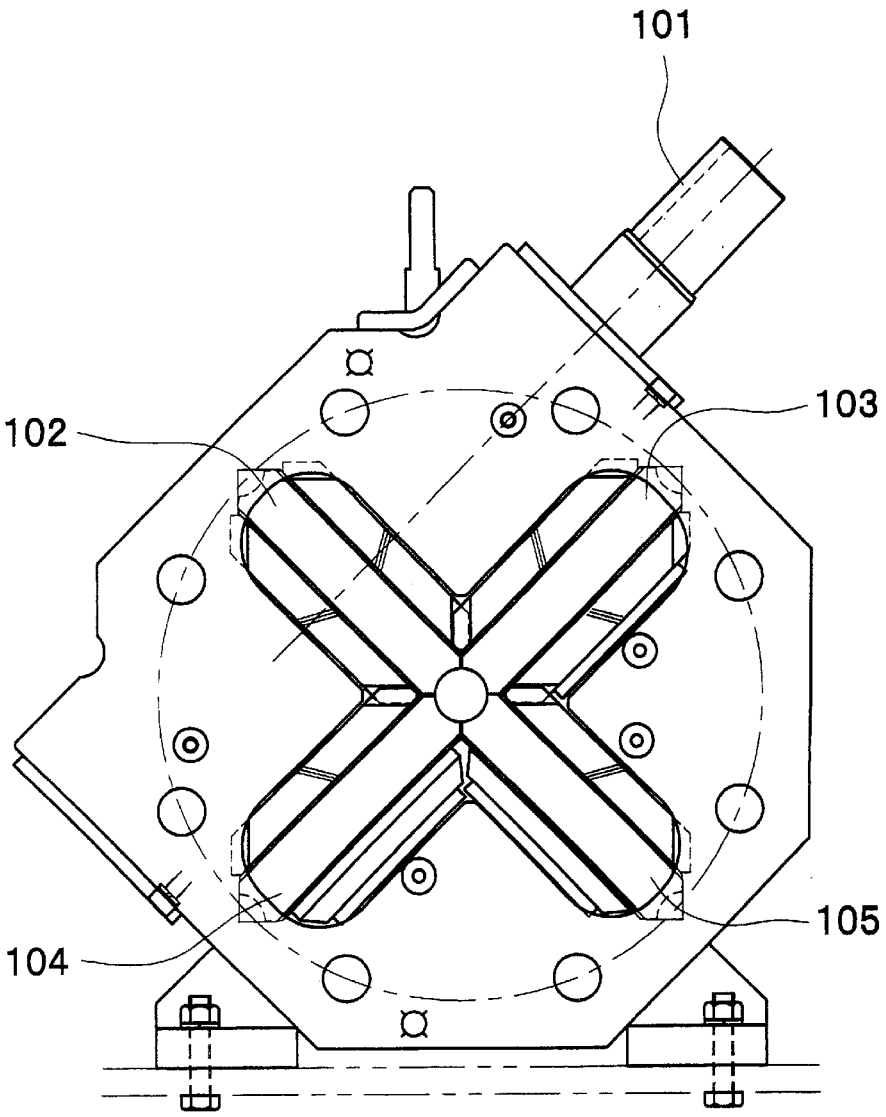
FIG. 11 is a front view of another conventional four-roll rolling mill.

FIGS. 9 and 1 show the drive unit A and the roll unit B coupled together. This coupling is accomplished as follows. The inner housing 13 of the roll unit B is fitted in the outer housing 3 of the drive unit A as is shown in FIG. 9. In this condition, the four positioning parts 14 of the outer housing 3 are in contact with the four positioning parts 15 of the inner housing 13, positioning the roll unit B laterally and longitudinally in the drive unit A without fail. At the same time, the inner housing 13 is received and stopped by the stoppers 16 of the outer housing 3 (rear section 3*b*) The hold-downs 17 are placed over the four contacting parts between the positioning parts 14 of the outer housing 3 and the positioning parts 15 of the inner housing 13 on the front side of the rolling mill, and the hold-downs 17 are fixed securely to the outer housing 3 by a fixing means such as bolts. Thus, the roll unit B is positioned in both directions of the pass line in the drive unit A and fixed. Then, the drive unit A is coupled with the roll unit B by couplings 40 so as to be ready for rolling operation.

In the above condition shown in FIG. 1, the rolls 1 can be rotated by turning the driving bevel gears 4 as mentioned earlier. Because the inner housing 13 is fixed in the outer housing 3 in the longitudinal and lateral directions and also in both directions of the pass line, high rolling precision can be achieved.

As described above, in this embodiment, roll units B and drive units A can be coupled and arranged in a rolling line, and roll units B and drive units A can be stored and managed separately by uncoupling them by couplings 40.

Besides, because roll units B for producing products of various sizes have no driving mechanism, they are almost free of maintenance and they can be made in a large number (for example, over 100) at a low cost. Moreover, because one drive unit A and one stand-by drive unit A suffice for each rolling mill regardless of the number of sizes of products, the cost of a rolling line can be reduced significantly. Furthermore, unlike the rolling mills of prior arts, it is unnecessary to disassemble the drive unit A each time rolls 1 are changed. Therefore, rolls 1 can be changed in a very short time, and there is no risk of damaging the drive unit A. Because the lubrication system of the drive unit A is packaged in the unit, it is unnecessary to change lubricant each time rolls 1 are changed.

In addition, rolls 1 can be changed just by uncoupling the front and rear sections 13*a* and 13*b* of the inner housing 13. Since rolls can be changed easily, it is not necessary to prepare one roll unit B for each product size. One roll unit B can be used for producing products of several sizes by changing rolls 1 in the roll unit B, which reduces the cost of a rolling line significantly.

In addition, just by removing the front section 3*a* or the rear section 3*b* of the outer housing 3, the driving means can be taken out from and built in the outer housing 3. Therefore, the inspection and maintenance of the driving means are very easy.

In FIG. 4, four rolls 1 are arranged in a slant posture. In this arrangement, because no transmission mechanism 8 takes a horizontal position, every roll 1 is driven by a transmission mechanism 8 comprising a first transmission shaft 11 and a second transmission shaft 12. Accordingly, only an input bevel gear 7 is mounted on the input shaft 6; a first cylindrical gear is not necessary.

According to prior arts, the driving shaft of a slant-roll rolling mill extends to the upper right, making its connection to a reducer bulky and high. According to the present invention, however, because the input shaft 6 can be disposed horizontally as shown in FIG. 4, its connection to a reducer can be made low and compact.

Although the above embodiments relate to four-roll rolling mills, the transmission mechanism 8 and the input shaft mechanism 5 can be applied to three-roll rolling mills. Namely, three rolls and three transmission mechanisms 8 are arranged 120° apart around the pass line, and the driving bevel gears 4 are disposed in the same manner as in the four-roll rolling mills to drive the three rolls. Because the input shaft of the input shaft mechanism 5 can be positioned horizontally, its connection to a driving reducer can be made compact and low.

The invention may be embodied in other specific forms without departing from the spirit or essential characteristics thereof. The above embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What we claim is:

1. A rolling mill comprising:

a housing;

a roll unit having a plurality of rolls arranged to roll material; and a drive unit to drive the roll unit, the drive unit comprising a large-diameter ring-like driving bevel gear, an input shaft mechanism for rotating the driving bevel gear, and transmission mechanisms each for transmitting the driving torque of the driving bevel gear to a roll.

2. A rolling mill as claimed in claim 1, wherein:

the drive unit has two driving bevel gears disposed face to face; and each transmission mechanism comprises a small-diameter transmission bevel gear caught between and engaging with the two driving bevel gears and a transmission shaft mechanism for transmitting the driving torque of the transmission bevel gear to a roll.

3. A rolling mill as claimed in claim 2, wherein each transmission shaft mechanism comprises:

a first transmission shaft on which the transmission bevel gear is fixed;

a first cylindrical gear fixed on the first transmission shaft;

a second transmission shaft connected to the roll shaft of a roll; and a second cylindrical gear fixed on the second transmission shaft and engaging the first cylindrical gear.

4. A rolling mill as claimed in claim 1 or 2, wherein the input shaft mechanism comprises an input shaft inserted from the outside to the inside of the housing and a small-diameter input bevel gear fixed on the input shaft and engaging the driving bevel gear(s).

5. A rolling mill as claimed in claim 4, wherein:

the roll unit comprises four rolls of a pair of horizontal rolls and a pair of vertical rolls; and the input shaft of the input shaft mechanism is disposed horizontally, taking the place of the first transmission shaft of a transmission shaft mechanism and driving the second transmission shaft.

6. A rolling mill as claimed in claim 4, wherein:

the roll unit comprises four rolls of a pair of slant rolls and another pair of slant rolls, the latter crossing the former at a right angle; and the input shaft of the input shaft mechanism is disposed horizontally.

7. A rolling mill as claimed in claim 4, wherein:

the roll unit comprises three rolls arranged 120° apart around the pass line; and the input shaft of the input shaft mechanism is disposed horizontally.

8. A rolling mill as claimed in claim 1, wherein:

the housing comprises an inner housing holding the roll unit and an outer housing holding the drive unit;

the outer housing is generally in the shape of a ring; and the driving bevel gear has an outer diameter slightly smaller than the inner diameter of the outer wall of the outer housing and an inner diameter larger than the diameter of a circle in contact with the outmost points of the rolls.

9. A rolling mill as claimed in claim 8, wherein:

the drive unit has two driving bevel gears disposed face to face;

each transmission mechanism comprises a small-diameter transmission bevel gear caught between and engaging with the two driving bevel gears and a transmission shaft mechanism for transmitting the driving torque of the transmission bevel gear to a roll;

the outer housing is split into a front section and a rear section;

one of the two driving bevel gears is journaled on a bearing in the front section; and the other driving bevel gear is journaled on a bearing in the rear section.

10. A rolling mill comprising:

a housing comprising an inner housing and an outer housing;

a roll unit comprising a plurality of rolls arranged in and held by the inner housing to roll material; and a drive unit comprising a driving means held in the outer housing to drive the roll unit, the roll unit and the drive unit being coupled by couplings capable of coupling and uncoupling;

the drive unit comprising a large-diameter ring-like driving bevel gear, an input shaft mechanism for rotating the driving bevel gear, and transmission mechanisms each for transmitting the driving torque of the driving bevel gear to a roll.

11. A rolling mill as claimed in claim 10, wherein:

the inner housing holding the roll unit has four positioning parts formed on its outer periphery;

the outer housing holding the drive unit is generally in the shape of a ring and has four positioning parts formed on its inner periphery; and the roll unit is positioned in the drive unit by putting the positioning parts of the inner housing in contact with the positioning parts of the outer housing.

12. A rolling mill as claimed in claim 11, wherein a means for fixing the roll unit to the drive unit is provided, the means comprising:

stoppers which are formed on the inner edge of the outer housing and protruding inward on one side of the rolling mill;

hold-downs placed over the inner edge of the outer housing and the outer edge of the inner housing on the other side of the rolling mill; and a means for fixing the hold-downs to the outer housing.

13. A rolling mill as claimed in claim 10, wherein the inner housing is split into a front section and a rear section, the rolls can be held in the inner housing by coupling its front and rear sections, and the rolls can be taken out from the inner housing by uncoupling its front and rear sections.

14. A rolling mill as claimed in claim 10, wherein the outer housing is split into a front section and a rear section, the driving means can be held in the outer housing by coupling its front and rear sections, and the driving means can be separated and taken out from the outer housing by uncoupling its front and rear sections.

15. A rolling mill as claimed in claim 11, wherein the four positioning parts of the inner housing and the four positioning parts of the outer housing have contacting surfaces for positioning the inner housing in the outer housing in the lateral and longitudinal directions and in the rotating directions about the pass line.

* * * * *